US008601931B2

(12) United States Patent
Naroditsky et al.

(10) Patent No.: US 8,601,931 B2
(45) Date of Patent: Dec. 10, 2013

(54) BELLY ARMOR

(75) Inventors: Dmitry Naroditsky, Kefar Sava (IL); Zvi Asaf, Kibbutz Afek (IL); Felix Aizik, D.N. Golan (IL)

(73) Assignee: Plasan Sasa Ltd., M.P. Marom Hagalil (IL)

( * ) Notice: Subject to any disclaimer, the term of this patent is extended or adjusted under 35 U.S.C. 154(b) by 212 days.

(21) Appl. No.: 13/191,255

(22) Filed: Jul. 26, 2011

(65) Prior Publication Data

US 2012/0174767 A1 Jul. 12, 2012

(30) Foreign Application Priority Data

Jul. 26, 2010 (IL) ..... 207241

(51) Int. Cl.
*F41H 7/02* (2006.01)

(52) U.S. Cl.
USPC ..... 89/36.08; 89/930

(58) Field of Classification Search
USPC ..... 89/36.07, 36.08, 36.09; 296/187.07, 296/193.07
See application file for complete search history.

(56) References Cited

U.S. PATENT DOCUMENTS

| | | | | |
|---|---|---|---|---|
| 5,398,592 | A * | 3/1995 | Turner | 89/36.08 |
| 5,533,781 | A | 7/1996 | Williams | |
| 5,705,765 | A * | 1/1998 | Singh et al. | 89/36.08 |
| 6,477,934 | B1 * | 11/2002 | Bruhn et al. | 296/193.07 |
| 6,779,431 | B2 * | 8/2004 | Honlinger | 296/193.07 |
| 7,159,503 | B1 * | 1/2007 | Weatherwax | 89/36.04 |
| 7,393,039 | B2 * | 7/2008 | Ravid et al. | 296/68.1 |
| 7,712,823 | B2 | 5/2010 | Greuter et al. | |
| 8,091,465 | B2 * | 1/2012 | Ravid et al. | 89/36.08 |
| 2003/0205917 | A1 * | 11/2003 | Preisler | 296/193.07 |
| 2007/0234896 | A1 * | 10/2007 | Joynt | 89/36.09 |
| 2008/0034953 | A1 * | 2/2008 | Barbe et al. | 89/36.01 |
| 2009/0140545 | A1 * | 6/2009 | Greuter et al. | 296/187.07 |
| 2010/0071539 | A1 * | 3/2010 | Boczek et al. | 89/36.08 |
| 2010/0102169 | A1 * | 4/2010 | Zorzetto et al. | 244/119 |
| 2010/0307329 | A1 * | 12/2010 | Kaswen et al. | 89/36.08 |
| 2010/0319525 | A1 * | 12/2010 | Pavon | 89/36.02 |
| 2011/0079134 | A1 | 4/2011 | JacQuemont et al. | |
| 2011/0138994 | A1 * | 6/2011 | Joynt et al. | 89/36.08 |
| 2011/0197744 | A1 * | 8/2011 | Cox | 89/36.02 |
| 2012/0210861 | A1 * | 8/2012 | Tobie | 89/36.04 |

FOREIGN PATENT DOCUMENTS

| | | |
|---|---|---|
| EP | 2 267 400 | 12/2010 |
| WO | WO 03/102489 | 12/2003 |
| WO | WO 2010/090661 | 8/2010 |

* cited by examiner

*Primary Examiner* — Bret Hayes
(74) *Attorney, Agent, or Firm* — Dorsey & Whitney LLP

(57) ABSTRACT

A blast armor including a base plate made of a ballistic material and having an inner and outer surface. The cover plate is made of ballistic material and spaced from the inner surface of the base plate to form a space therebetween. The armor comprises at least one energy absorbing module disposed within the space between the base and cover plate. The module has front and rear surfaces, and side surfaces extending therebetween. The module is positioned with at least one of its surfaces facing the base plate and at least another surface thereof facing the cover plate. The base and cover plate are each made of a material tougher than that of the module. The module is configured to progressively deform between the base and cover plate under the application of a force to the outer surface of the base plate at least partially directed towards its inner surface.

26 Claims, 12 Drawing Sheets

BELLY ARMOR

CROSS-REFERENCE TO RELATED APPLICATIONS

This application claims priority to Israel Patent Application No. 207241 filed on 26 Jul. 2010, the contents of which are incorporated herein, in their entirety, by this reference.

TECHNICAL FIELD

Embodiments of the invention relate to belly armor and, in particular, armor constructions adapted for articulation to the belly of a vehicle.

BACKGROUND

It is well known to provide vehicles with add-on armor, in order to protect the occupants of the vehicle from different threats, for example, incoming projectiles or nearby explosions. Adding armor is usually performed for combat and logistics vehicles taking part in military operations or stationed in hostile environments.

In particular, one major threat to combat and logistics vehicles is explosive devices usually buried or concealed along roads on which the combat vehicle travels, and designed to explode (under a belly of the vehicle), when the vehicle comes to the location of the explosive device, or passes thereover.

Such an explosion, can cause structural damage to the belly of the vehicle (e.g. rupture, penetration etc.), hurting its occupants (e.g. soldiers). For this purpose, armor is commonly attached to the belly of the vehicle (also referred to as 'belly armor'), and adapted to shield the belly from the explosion hazards.

Various constructions for protecting a vehicle belly are known, for example, such constructions as described in U.S. Pat. No. 7,712,823, WO2010/090661, EP2267400, U.S. Pat. No. 5,533,781 and US2011/0079134.

SUMMARY

According to one aspect of the subject matter of the present application, there is provided a blast armor for a belly of a vehicle, comprising:

- a base plate made of a ballistic material and having an inner surface and an outer surface;
- a cover plate made of ballistic material and spaced from the inner surface of the base plate to form a space therebetween; and
- at least one energy absorbing module disposed within the space between the base plate and the cover plate, the module having:
  - a front surface;
  - a rear surface; and
  - side surfaces extending therebetween;
  - the energy absorbing module being positioned so that at least one of its surfaces faces the base plate and at least one other surface thereof faces the cover plate;

wherein:

- the base plate and the cover plate are each made of a material having a toughness greater than that of the energy absorbing module/s; and
- the module is configured, to progressively collapse/deform between the base plate and the cover plate, under the application of a force to the outer surface of the base plate at least partially directed towards its inner surface.

The module can occupy an area constituting a minority of the area of the base plate and of the cover plate, and it can be provided with a frame confining the module at least at two sides thereof, and attached to the inner surface of the base plate. The arrangement may be such that a plurality of module can be used to cover the majority of the inner surface of the base plate.

The frame of the module can be in the form of a cell formed at the inner surface of the base plate and having at least two opposing side walls. The cell can be formed by at least one grid beam attached to the inner surface of the base plate and projecting therefrom towards the cover plate.

According to one example, the length of the grid beams can be sufficiently short so as to allow a plurality of such beams to cover the inner surface of any desired base plate. Alternatively, at least one of the grid beams can be curved so as to form at least one cell configured for accommodating an energy absorbing module, and can even be sufficiently long and convoluted so that it forms several such cells.

The energy absorbing module can be positioned within the cell such that the module is confined by the cell's walls, and by the base and the cover plates. In particular, the module can be confined:

- at its front face by the base plate;
- along its side faces by the side walls of the cell; and
- at its rear face by the cover plate.

According to one example, both the base plate and the cover plate can be made of the same material, which has a toughness greater than that of the energy absorbing module. Alternatively, the base plate and the cover plate can be made of different materials, each of which has a toughness greater than that of the energy absorbing module.

The base plate can be made of a single continuous piece of ballistic material, e.g. rolled homogenous armor (RHA). Alternatively, it can be made of several units constituting together the base plate. In any case, the base plate can be such that withstands the impact of a level 3 explosion on the STANAG 4569 scale (NATO Standardization Agreement covering the standards for the "*Protection Levels for Occupants of Logistic and Light Armored Vehicles*").

In particular, the arrangement may be such that while the armor may be adapted to withstand the above level 3 explosion, the same armor without the energy absorbing modules may be configured for withstanding a level 2 on the STANAG 4569 scale.

For example, both the base plate and the cover plate can have a nominal hardness ranging between 220 and 650 BHN. However, since the cover plate is positioned behind the base plate (with respect to an explosion under the belly of the vehicle), and the base plate is the first to absorb the energy of the explosion, the cover plate can have a thickness which is lower than that of base plate. For example, the thickness of the cover plate may be between about 25-50% of the thickness of the base plate. According to a particular example, the base plate can have thickness of 12.7 mm while the cover plate can have a thickness of only 4.5 mm.

The armor can further comprise a plurality of grid beams at the inner surface of the base plate so that a grid of cells is formed along the inner surface, configured for holding therein a plurality of energy absorbing modules. The number of energy absorbing modules can be equal to the number of cells formed by the grid beams, so that each cell is occupied by one energy absorbing module, adjacent modules being separated from each other by the cells' walls. Alternatively, only some of the cells can be occupied by the energy absorbing modules.

There can be several types of grid beams forming the cells grid, each type being configured for attachment to a different area of the inner surface of the base plate according to the design and geometry of the latter. For example, the base plate can have a planar portion and at least one curved portion, and correspondingly, one type of the grid beams can be straight to fit the planar portion, while another type of the grid beams can be curved to fit the curved portion.

The grid beams are configured so as to provide the armor with a required structural integrity, i.e. to allow both the base plate and the cover plate to absorb at least the majority of the energy of the explosion without deforming to an extent affecting the occupants of the vehicle. Thus, the grid beams do not take up more than 30% of the overall area of the inner surface, more particularly no more than 25%, and even more particularly no more than 20% of the overall inner surface. It follows from this, that the majority of the inner surface of the base plate is covered by the energy absorbing modules.

The grid beams can be made of materials, which, on the one hand provide the required structural integrity for the base plate, and on the other hand, are sufficiently deformable (under an explosion loading), to allow the base plate and the cover plate to absorb part of the energy of the explosion against which the armor is designed and transmit this energy to the energy absorbing modules. In other words, the grid beams should allow the base plate to deform to an extent which is, on the one hand sufficient to apply pressure to the energy absorbing modules so as to cause them to collapse and absorb the energy of the explosion, and on the other hand, do not allow the base plate to deform to an extent endangering the passengers of the vehicle. For example, the grid beams can be made of metal, for example iron, steel or steel/titanium/aluminum alloy.

For construction purposes, the base plate can be pre-formed with attachment ports for the attachment of the grid beams thereto, and the grid beams can be correspondingly sized and shaped, and have corresponding attachment ports so as to be articulated to the base plate. Articulation of the grid beams to the base plate can be detachable, e.g. using bolts, or can be a fixed attachment, e.g. using welding.

The cover plate can also be pre-formed with attachment ports for attachment to the grid beams, and can be sized and shaped so as to confine, when attached to the beams, the grid beams between the base plate and the cover plate.

Each of the energy absorbing modules can be in the form of a tile, configured for being laid within the cell, and can be adapted for undergoing progressive collapse/deformation under application of a sufficient load thereto (e.g. in the case of deformation of the base plate as a result of an explosion).

In particular, the energy absorbing module can have a density which is in the range of 5%-35% of the density of the material comprising the majority of the volume of the module. In other words, if the majority of the volume of the module is constituted by material A, the density of the module may be in the range of 5%-35% of the density of A. Alternatively, the energy absorbing module can be designed such that the density thereof does not exceed 2.8 g/cm^3.

In addition, the specific weight of the energy absorbing module can be lower than the specific weight of the base plate and of the cover plate. In other words, the arrangement can be such that, in comparison with an initial armor, reducing the thickness/size of the base plate and/or cover plate on account of adding an energy absorbing module/s, while providing the same ballistic protection, yields an armor with an overall weight which is lower than that of the initial armor.

Furthermore, the arrangement can be such that, compared to a reference armor having a similar design but without energy absorbing modules, a thickness X of the base plate and cover plate combined, and configured for withstanding the same level of explosion, the thickness of the base plate of the present armor (on account of the energy absorbing modules) can be reduced to about 0.65×. In other words, the existence of the modules compensates for about 0.35× of the thickness of the base plate.

One of the advantages to the above described arrangement is that most of the area of the inner surface of the base plate, and consequently, most of the volume of the armor is constituted by low-density, light-weight modules. The overall reduction in the weight of the armor can allow increasing the thickness of the base plate (and consequently the weight of the armor) on account of the overall low weight of the armor.

The energy absorbing module can be made of a low-density porous material. One example of such a porous material can be metallic foam, in particular, Aluminum foam. Alternatively, the module may be in the form of a low density structure. One example of such a structure can be a honeycomb structure. In any of the cases, the majority of the volume of the energy absorbing module can be constituted by the spaces/pores.

The energy absorbing module can be encapsulated by a covering layer, so as to protect the module, so that the module does not undergo collapse/deformation as a result of shocks and vibrations inflicted thereon which are not caused by an explosion or an impacting projectile. Thus, the covering layer can be, on the one hand, tough and robust enough to securely shield the module, and, on the other hand, can be deformable enough to allow the module to undergo the desired deformation during the explosion/impact.

In particular, the covering layer can have an elongation coefficient of about 20%, more particularly, at least 15%, and even more particularly, at least 10%. The covering layer can be made of resin, polyurethane, polyurea, rubber types etc.

It should also be appreciated that armor is usually designed corresponding to the size and shape of the body it is configured to protect, so that different shaped bodies are usually fitted with different shaped armors (and consequently, different shaped base plates). The arrangement can be such that the energy absorbing modules are of a shape and size allowing for a plurality of such modules to cover the inner surface of base plates of various designs. In other words, the arrangement is modular, in the sense that the same energy absorbing modules can be fitted in the cells of different base plates of different belly armors.

In assembly, the grid beams are attached to the base plate so as to form the cells, each of which is in the shape of a 3D space delimited by the inner surface of the base plate and the side walls of the grid beams. The 3D space is sized and shaped for accommodating therein an energy absorbing module.

The modules are then fitted into the respective cells, such that the front face thereof is facing the base plate, and can even come in contact therewith, and the side faces thereof are facing the side walls and can even come in contact therewith. In this position, the energy absorbing module is securely confined inside the cell and is positioned therein without the need for any articulation means.

It should be noted that according to a particular design, the energy absorbing module is only held securely between the inner surface of the base plate, and the cover plate, i.e. the side faces of the module do not come in contact with the grid beams defining its respective cell so that there exists a gap between the side faces of the module and the grid beams. One advantage which can arise from such a design is that, during explosion loading, the energy absorbing module is pressed between the base plate and the cover plate, and as a result deforms and expands sideways. Thus, the gap between the grid beams and the side faces of the module provides it with just enough space to expand during deformation.

Once the energy absorbing modules are positioned within the cells, the cover plate is attached to the grid beams so as to encapsulate them, such that the rear face of the energy absorbing modules is facing the cover plate, and can even come in contact therewith. The term 'encapsulate' is used herein to define that the energy absorbing module is confined on all sides, in particular, by the inner surface of the base plate at the front face thereon, by the cover plate at the rear face thereof, and by the side walls of the grid beams at the side faces thereof.

In attachment to the vehicle, the armor is mounted onto the body of the vehicle so as to be oriented such that the inner surface of the cover plate is facing a belly of the vehicle while the outer surface of the base plate is facing away from the vehicle.

The base plate (and consequently the armor) can extend along a direction defined between the front and the rear of the vehicle, and have a central portion extending along the direction, and two peripheral portions also extending along the first direction on both sides of the central portion. In particular, the central portion can have a ballistic resistance which is greater than that of the peripheral portions.

According to one example, the central portion of the base plate can be fitted with one or more additional elements configured for providing the central portion with an increased ballistic resistance, e.g. and additional armor member mounted onto the central portion. According to another example, the central portion of the base plate can be of increased thickness compared to the peripheral portions, in order to provide it with the increase ballistic resistance. It should be noted that both examples can be implemented together, i.e. a central portion of increased thickness and also provided with an additional armor member.

The armor can be an add-on armor, adapted to be attached in a removable manner to the body to be extra protected. In particular, the armor can be formed with attachment ports configured for attachment thereof to the body to be protected.

According to a specific example, the base plate of the armor can be fitted or integrally provided with at least two extensions being formed with the attachment ports. In particular, the armor can be can be sized and shaped for mounting, externally, onto the belly of a vehicle comprising a hull having the belly and side walls extending therefrom, such that, when mounted, the attachment ports of the extensions can engage corresponding ports formed in the hull.

The arrangement can be such that the extensions constitute part of the peripheral portions of the base plate.

According to one example, the arrangement can be such that the armor attaches directly to the hull, through its side walls or through the belly itself. Alternatively, according to another example, the side walls or belly of the vehicle can be fitted with one or more intermediary members fixedly attached thereto, the intermediary member being configured for attachment thereto of the extensions of the base plate.

Each intermediary member can extend in a direction parallel to the belly of the hull (i.e. a direction extending between a front of the vehicle and a rear thereof), and can have, in a cross-section taken along a plane perpendicular to this direction, at least one side configured for attachment to the hull and another side configured for attachment thereto of the base plate of the armor. According to a specific example, the intermediary member can extend along the side walls of the hull of the vehicle.

The base plate of the armor can be V-shaped in a cross-section taken along a plane perpendicular to the front-rear direction of the vehicle (when mounted thereto), such that peripheral portions thereof formed with the attachment ports are angled to the side walls of the vehicle hull. For this purpose, the intermediary member, in cross section taken along the same plane, can be formed with a first side oriented parallel to the side wall of the hull, and a second side wall angled to the first side wall, and configured to be oriented parallel to the peripheral portion of the base plate.

According to another aspect of the subject matter of the present application, there is provided an armored vehicle comprising:

- a hull having:
  - a front end and a rear end defining therebetween a first direction of the vehicle:
  - a belly extending along the first direction; and
  - side walls extending along the first direction transverse to the belly.
- a belly armor according to the previous aspect of the subject matter of the present application mounted onto the vehicle hull;
- so that when mounted, the cover plate, grid beams and energy absorbing modules are disposed between the base plate and the belly of the vehicle.

BRIEF DESCRIPTION OF THE DRAWINGS

In order to understand the invention and to see how it can be carried out in practice, embodiments will now be described, by way of non-limiting example only, with reference to the accompanying drawings, in which.

DETAILED DESCRIPTION OF EMBODIMENTS

Figure 1A:
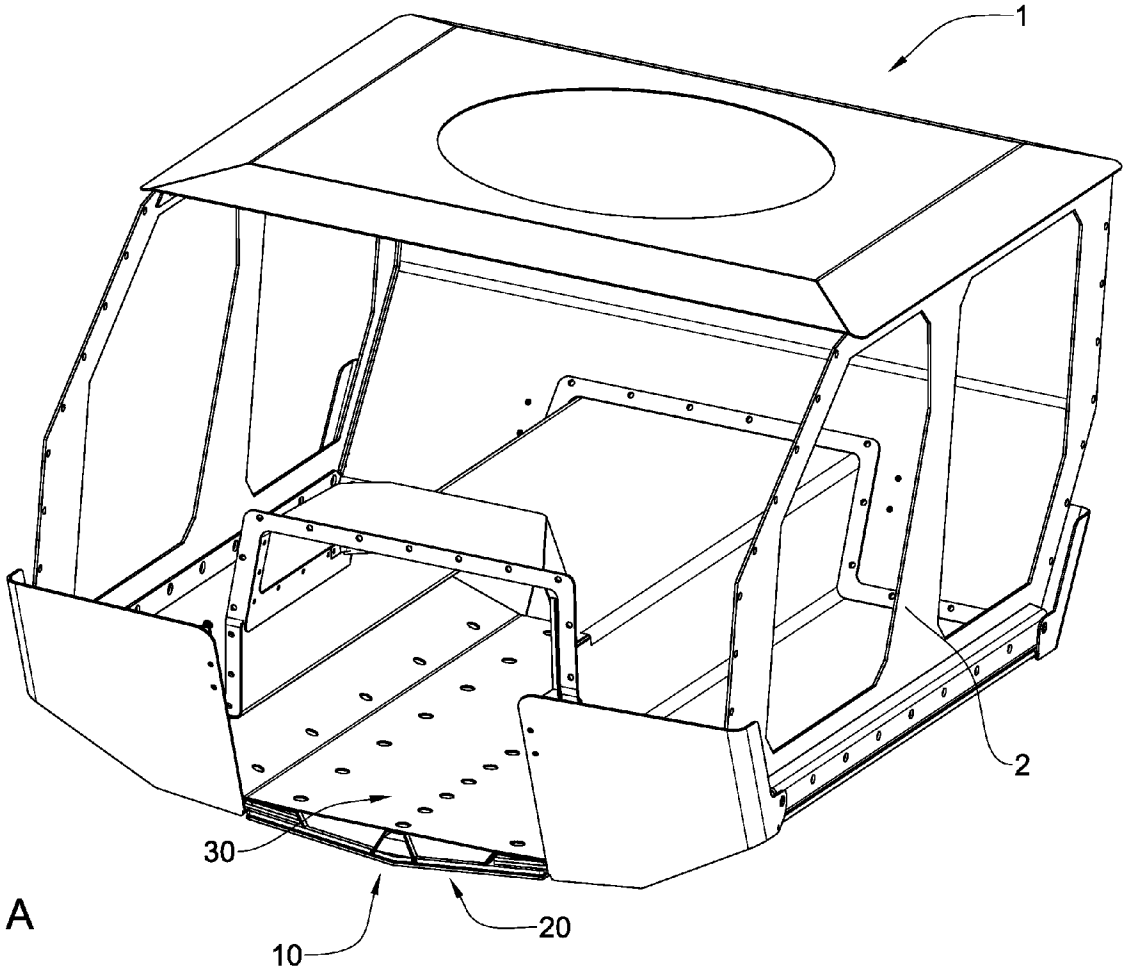
FIGS. 1A and 1B are schematic and respective isometric and front views of an armored vehicle hull comprising a belly armor according to the subject matter of the present application.
Figure 1B:
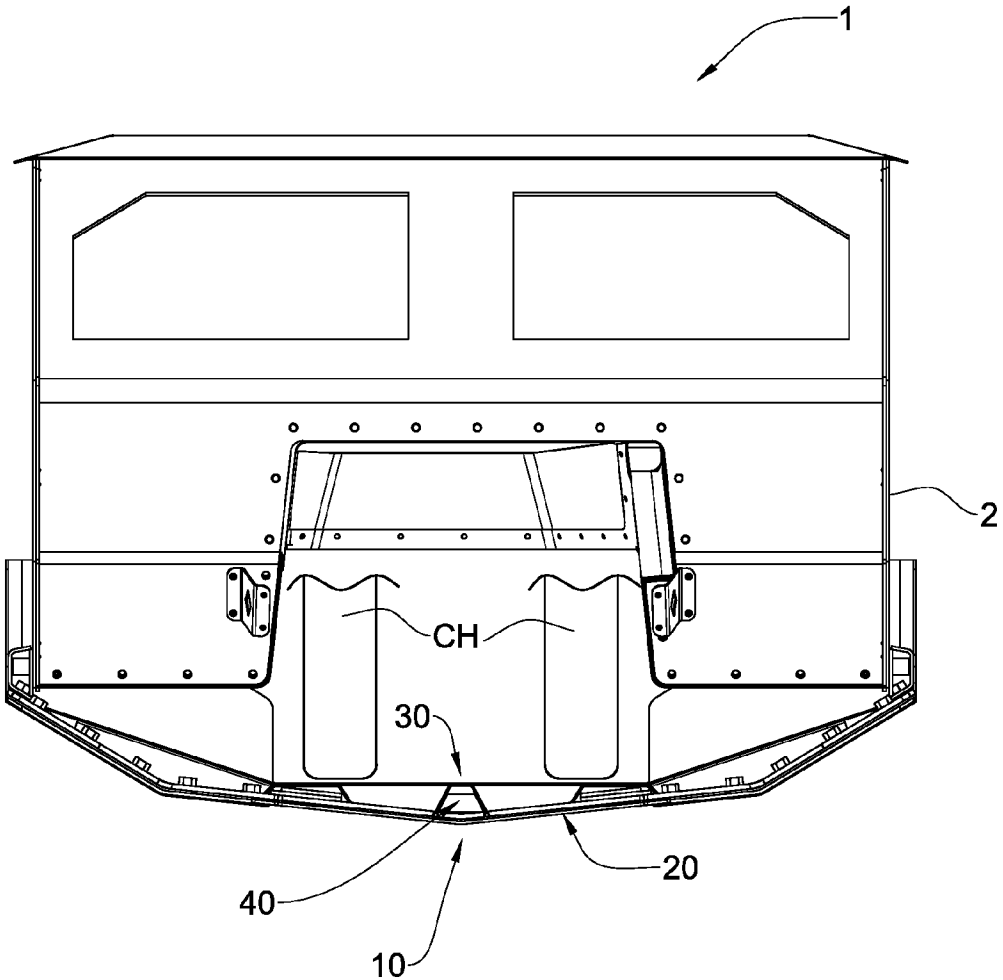
Figure 1C:
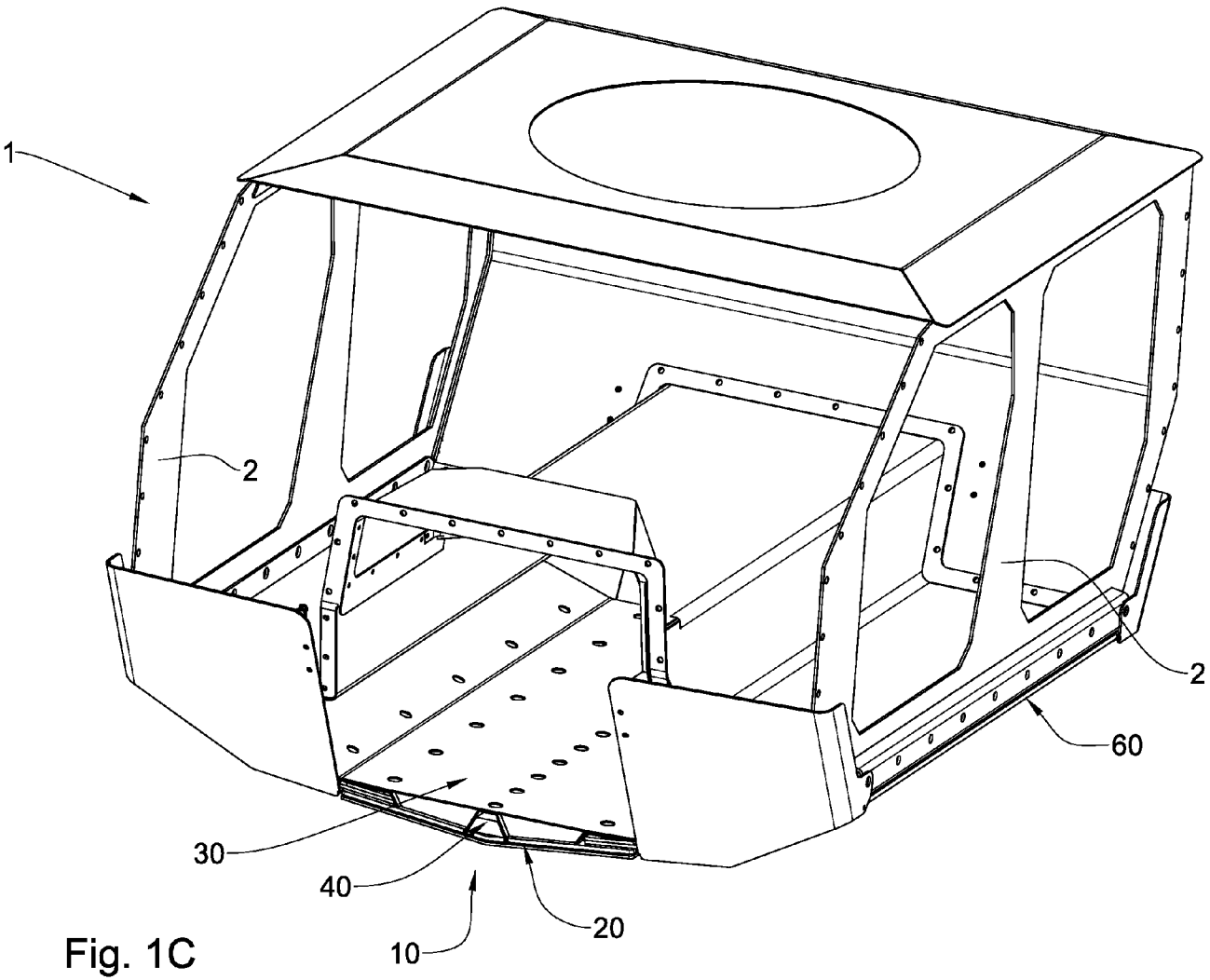
FIG. 1C is a schematic isometric view of the hull shown in FIG. 1A, with some of the components removed.

With reference to FIGS. 1A to 1C, there is shown an armored hull of a vehicle generally designated as 1, having side walls 2 and a belly (not shown), the armored hull being fitted with a belly armor, generally designated as 10.

Turning now to FIGS. 2A to 2G, the belly armor 10 comprises a base plate 22, a cover plate 30 and an energy absorbing arrangement 40 disposed between the base plate 22 and the cover plate 30.

The base plate 22 has an inner surface 22*i* and an outer surface 22*o*, in cross-section taken along a plane perpendicular to the direction extending between the front and the rear of the vehicle 1, a concave shape, with a central portion 22C and two peripheral portions 22P extending on both sides of the central portion 22C. The base plate is made of HH or UHH steel and has a thickness of about 0.5".

Thus, it is appreciated that when the belly armor 10 is mounted onto the vehicle 1, and the vehicle 1 is positioned on the ground, the central portion 22C is closer to the ground than the peripheral portions 22P. Therefore, in the event of an explosion under the belly of the vehicle 1, the central portion 22C is the first to experience the force of the explosion, and is configured, due to the concave shape, to deflect the blast to the peripheral portions 22P.

For this reason, the central portion 22C of the base plate 22 is fitted at its outer surface 22*o* with a reinforcement plate 24, so as to thicken it, and make it more blast resistant. The reinforcement plate 24 is of a thickness smaller than that of the base plate 22 (e.g. 0.25"), and is made of the same HH or UHH steel. Adding of the reinforcement plate 24 provides an increased thickness of central portion of the base plate assembly 20 to about 0.75".

Between the base plate 22 and the reinforcement plate 24, there is lined a layer of reinforced glass fibers (GRF).

With particular reference being made to FIG. 2D to 2G, the belly armor 10 is shown with the cover plate 30 removed, so as to expose the energy absorbing arrangement 40. The energy absorbing arrangement 40 comprises a plurality of longitudinal grid beams 42, 44, and transverse grid beams 46, 48 disposed on the inner surface of the inner plate 22B, so as to form a grid of cells 43, configured for structurally reinforcing the base plate assembly 20.

The arrangement of the beams 42, 44, 46 and 48 is such that, besides structurally reinforcing the base plate assembly 20, there are formed spaces between the beams referred herein as cells. Along the central portion 22C, the beams 42, 44 and 48 form rectangular cells 43, while at the peripheral portions 22P, the beams 42 and 46 form together cells 45.

Transverse beams 48 are disposed between the longitudinal beams 42, 44 so as to form generally rectangular cells 45, in which the energy absorbing modules are located. The beams 48 are generally thin, and are used merely to confine each of the modules 50 within a four-wall cell.

The beams 46 are disposed on both sides of the central portion 22C of the base plate 20, bridging the central portion 22C and the peripheral portion 22P. Each such beam 46 has a generally triangular cross-section, such that one side of the triangle is supported by the central portion 22C, while the other side of the triangle is supported by the peripheral portion 22P (the third side of the triangle is facing the cover plate 30).

The transverse beams 46 defined between each two neighboring beams a cell 47 in which an energy absorbing modules can be confined. It is noted that, unlike in the central portion 22C, this cell 47 is not four-walled, but rather two-walled, open at both ends.

The longitudinal beams 42, 44 extend along the central portion of the base plate 22, the longitudinal beam 44 being thinner, and disposed between the two longitudinal beams 42 which are of greater width.

The arrangement can be such that the two longitudinal beams 42 are disposed, when the belly armor 10 is mounted onto the hull 1, under the chassis of the vehicle (see FIG. 1B, as denoted CH in FIG. 1B, thus also using the chassis to provide additional deformation resistance to the armor 10 during an explosion. It should be noted however, that when mounted, there does not have to be direct contact between the belly armor 10 and the chassis CH.

Figure 2A:
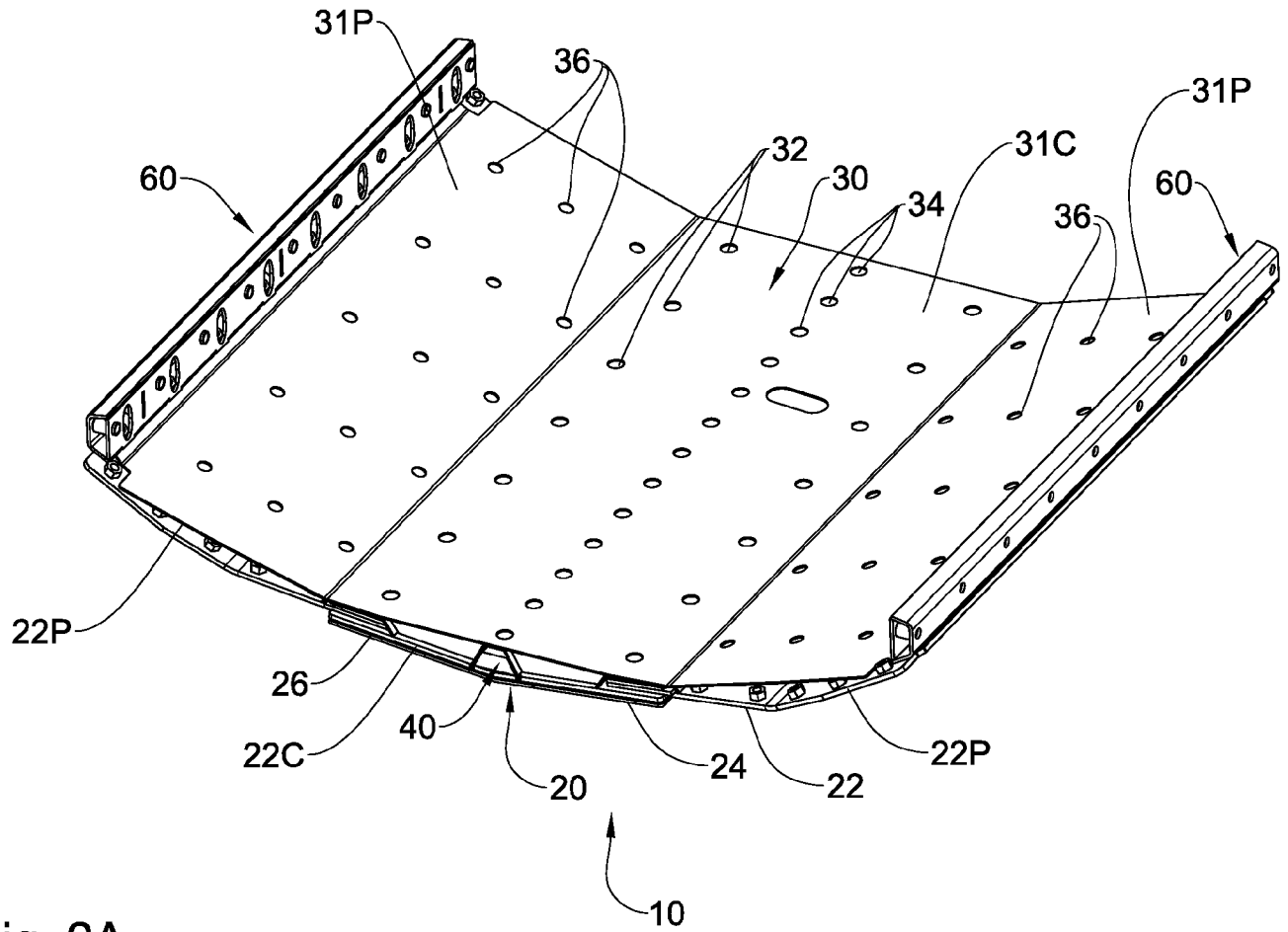
FIGS. 2A and 2B are schematic and respective top and bottom isometric views of the belly armor shown in FIGS. 1A and 1B.
Figure 2B:
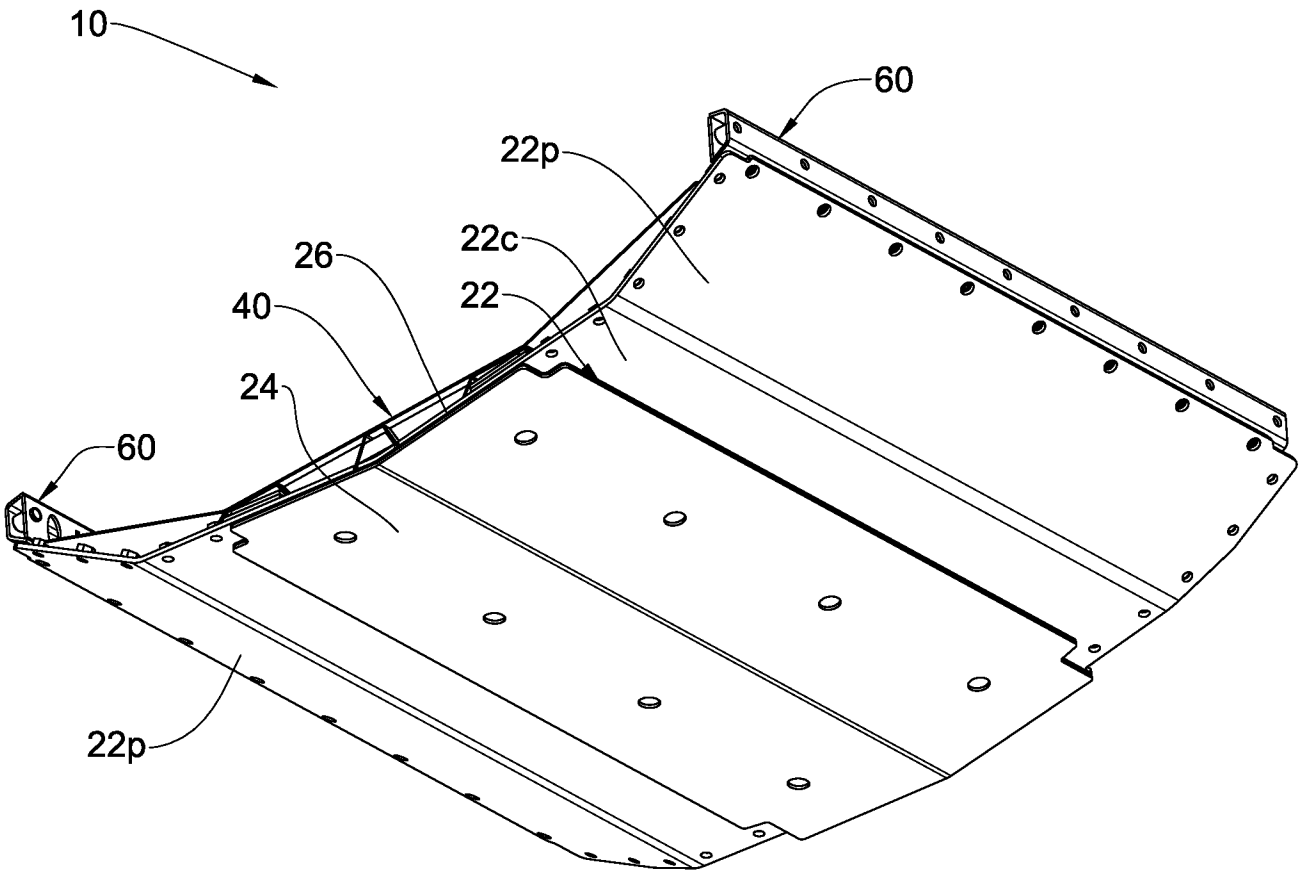
Figure 2C:
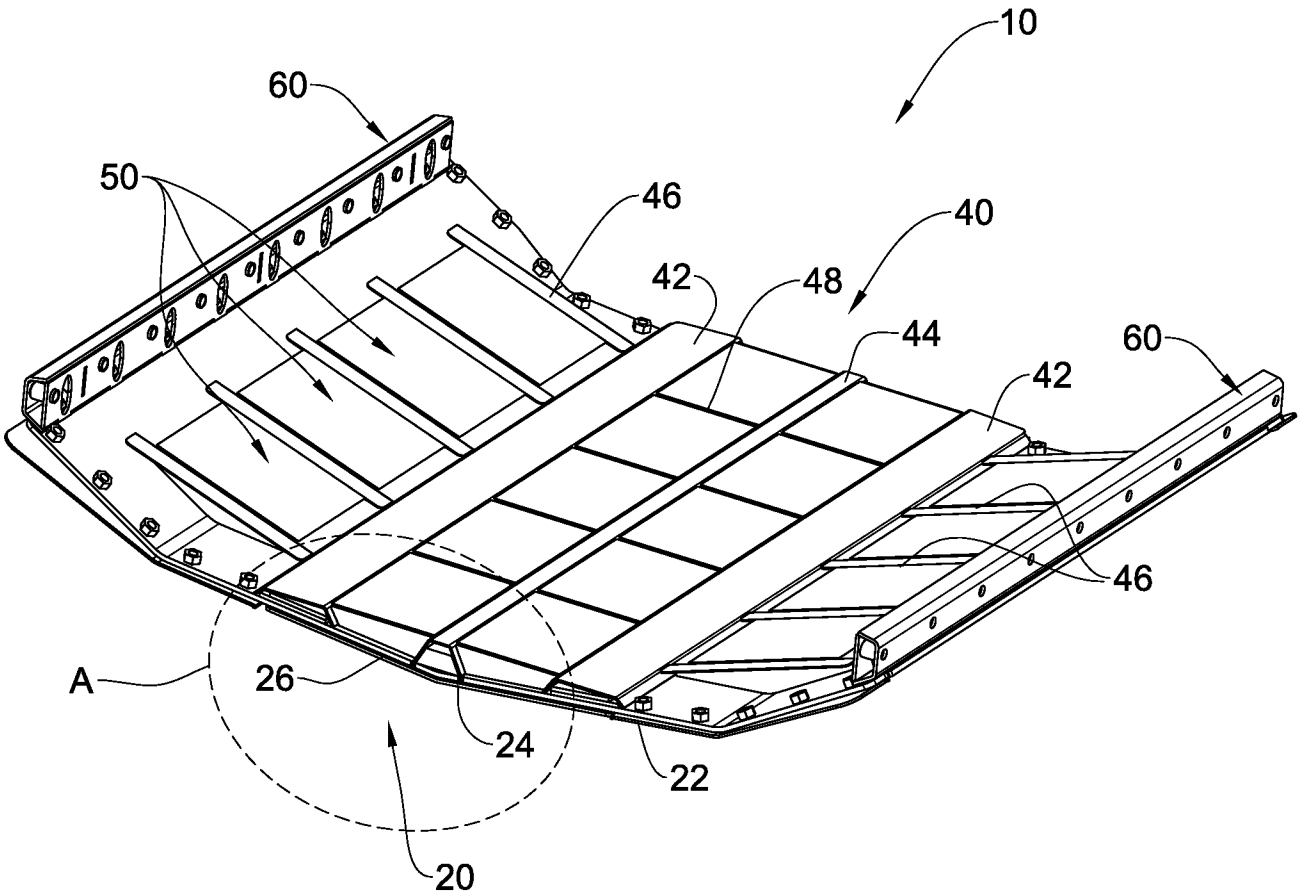
FIG. 2C is a schematic isometric view of the belly armor shown in FIG. 1A, with a cover plate thereof being removed.
Figure 2D:
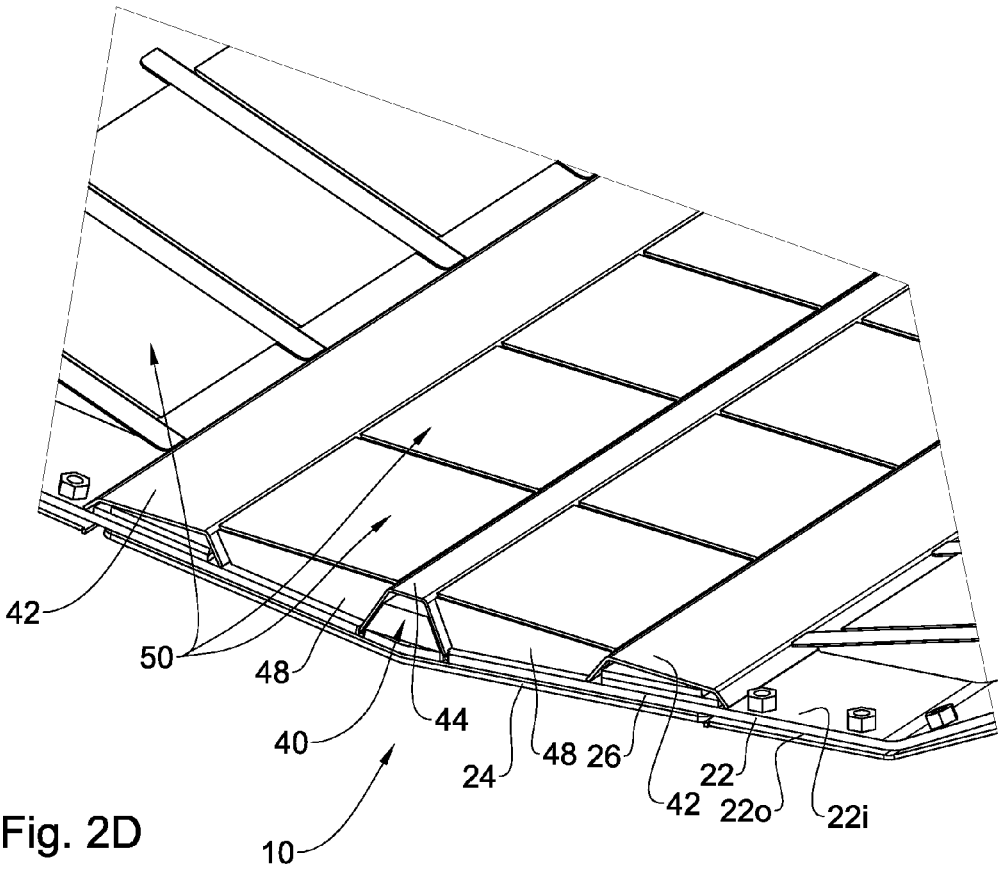
FIG. 2D is a schematic enlarged view of detail A shown in FIG. 2C.
Figure 2G:
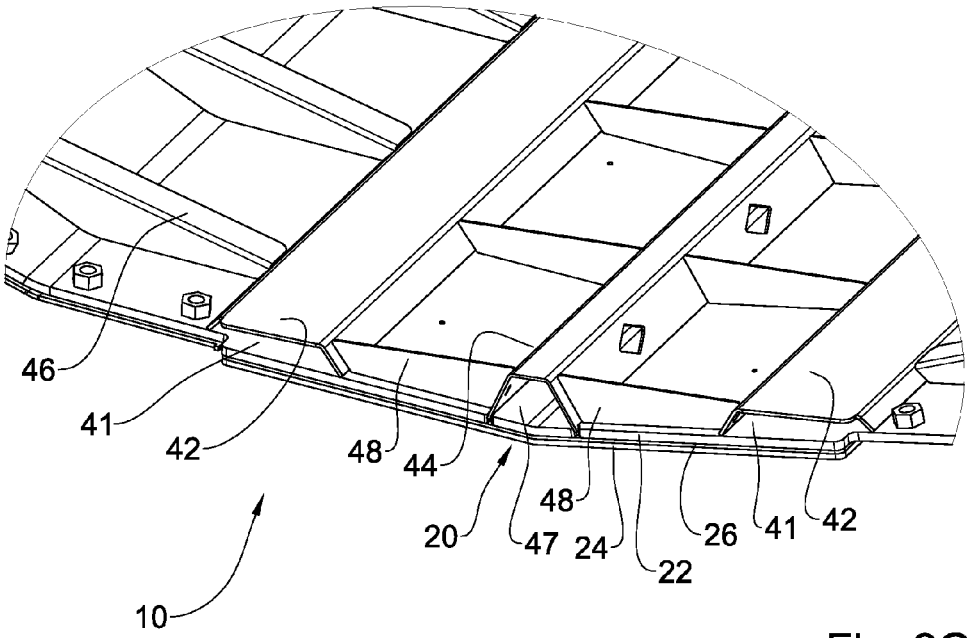
FIG. 2G is a schematic enlarged view of detail B shown in FIG. 2F.
Figure 2E:
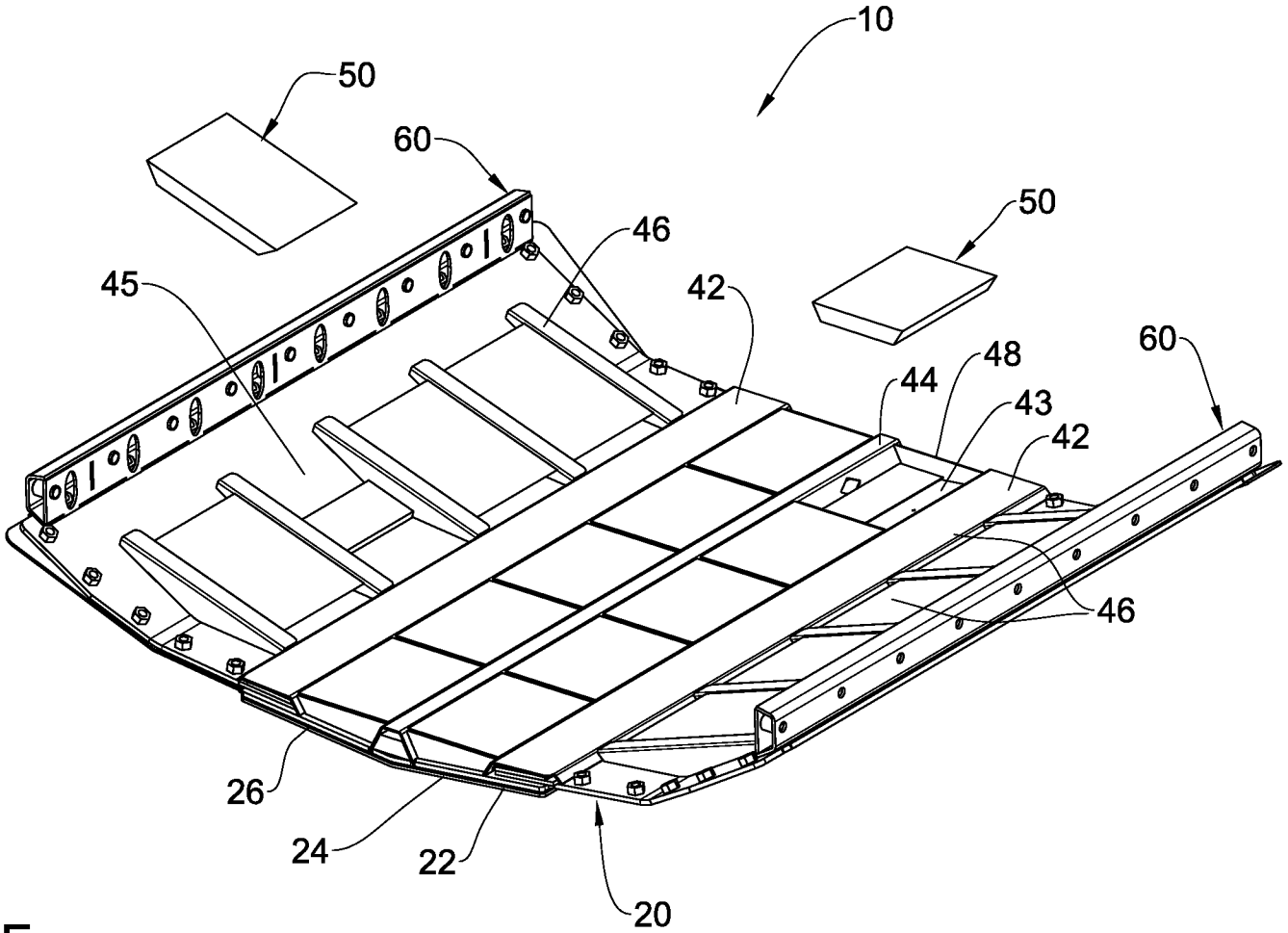
FIG. 2E is a schematic isometric view of the belly armor shown in FIG. 2C, with some of the energy absorbing modules thereof being removed.
Figure 2F:
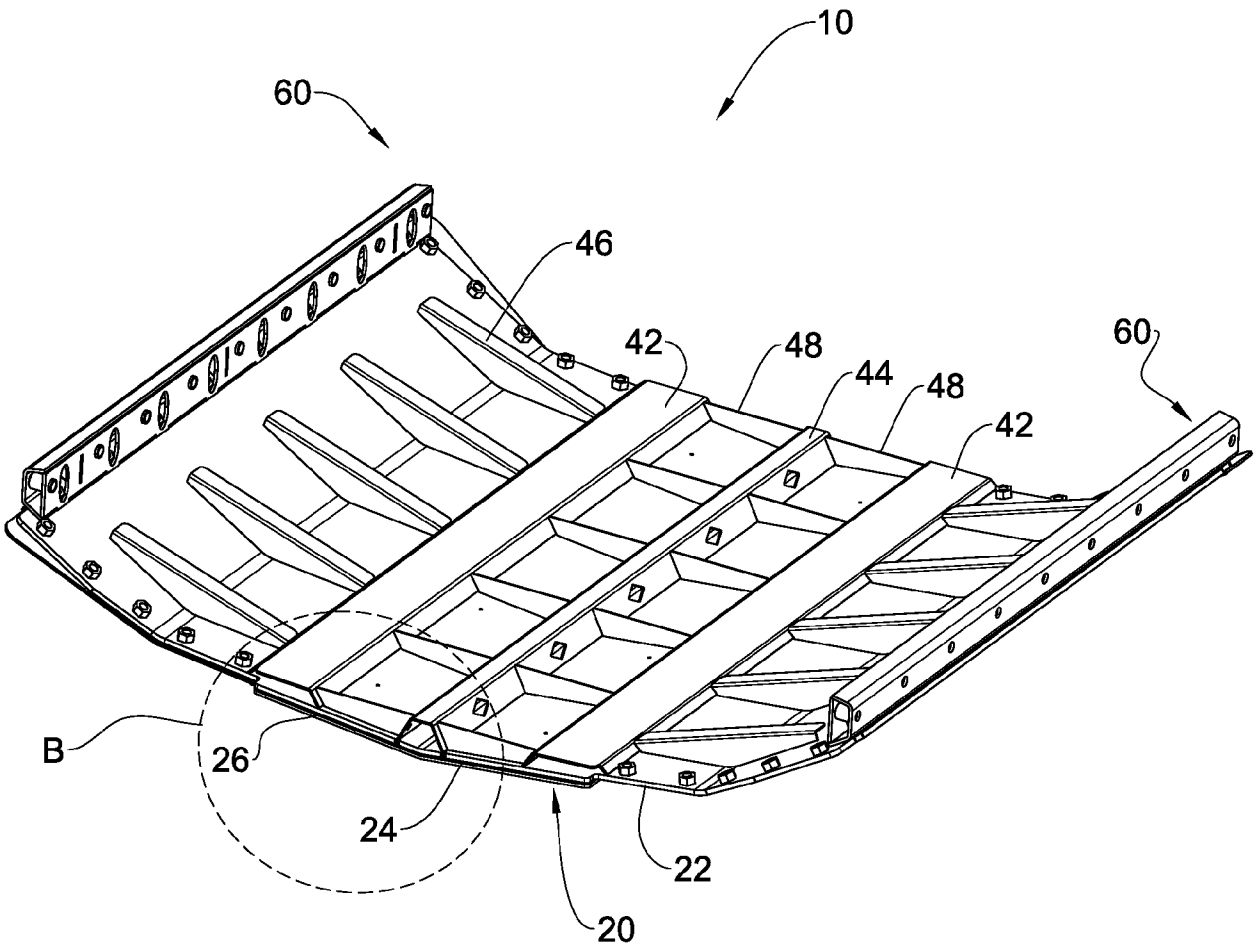
FIG. 2F is a schematic isometric view of the belly armor shown in FIG. 2E, with all the energy absorbing modules removed.
Figure 3A:
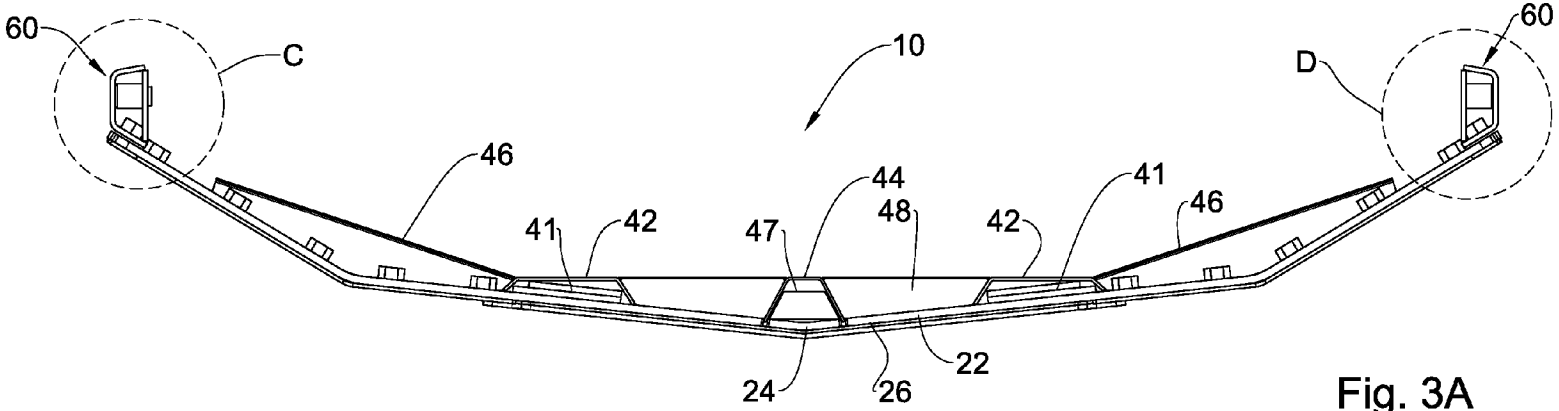
FIG. 3A is a schematic front view of the belly armor shown in FIG. 2A, when attached to an intermediary attachment members.
Figure 3B:
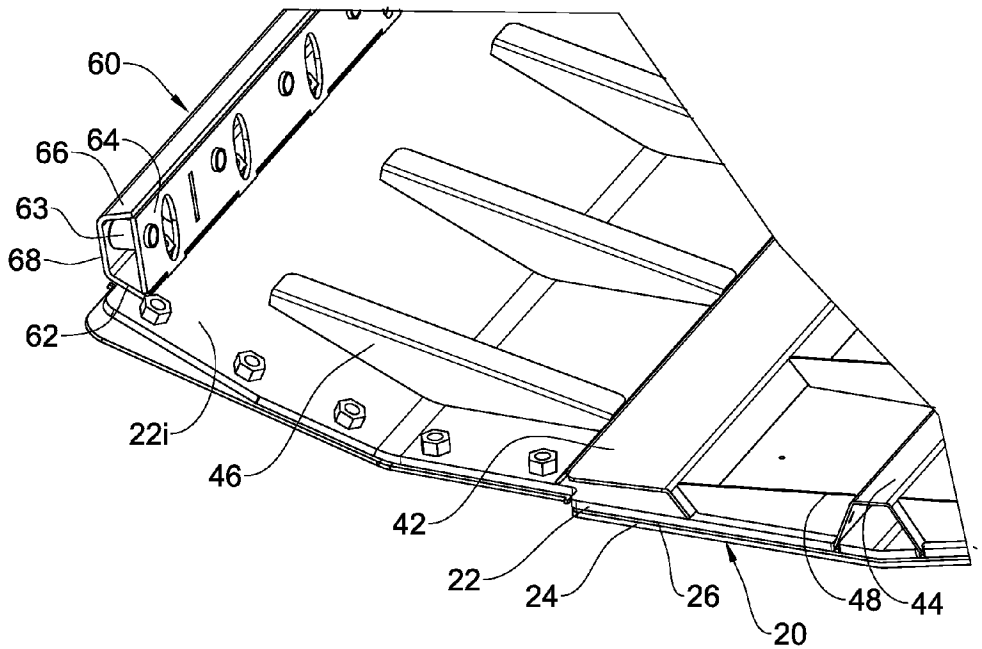
FIG. 3B is an enlarged isometric view of a detail C shown in FIG. 3A.
Figure 3C:
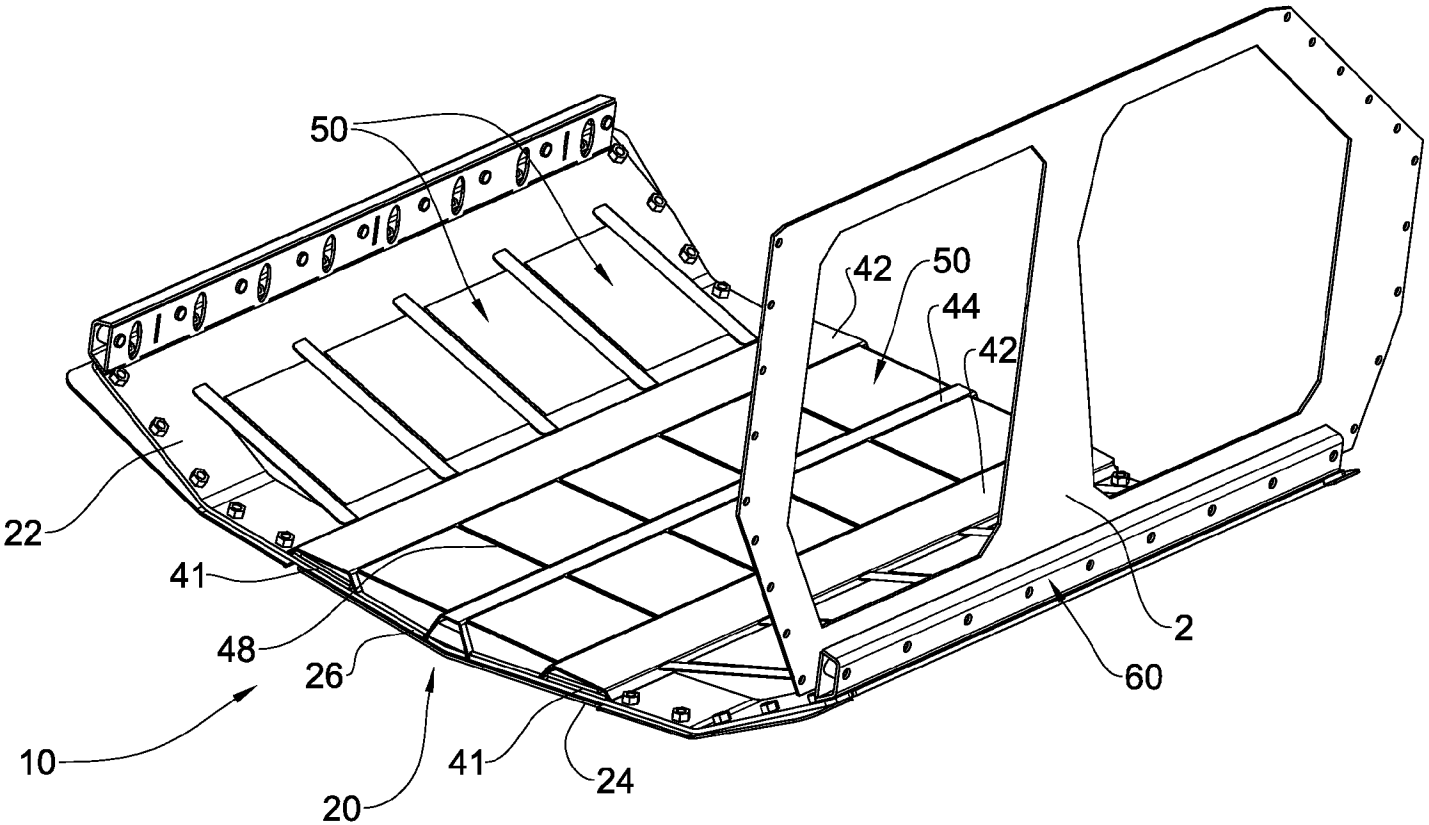
FIG. 3C is a schematic isometric view of the belly armor shown in FIG. 3A, when attached to a side wall of the hull of the vehicle shown in FIG. 1A.
Figure 3D:
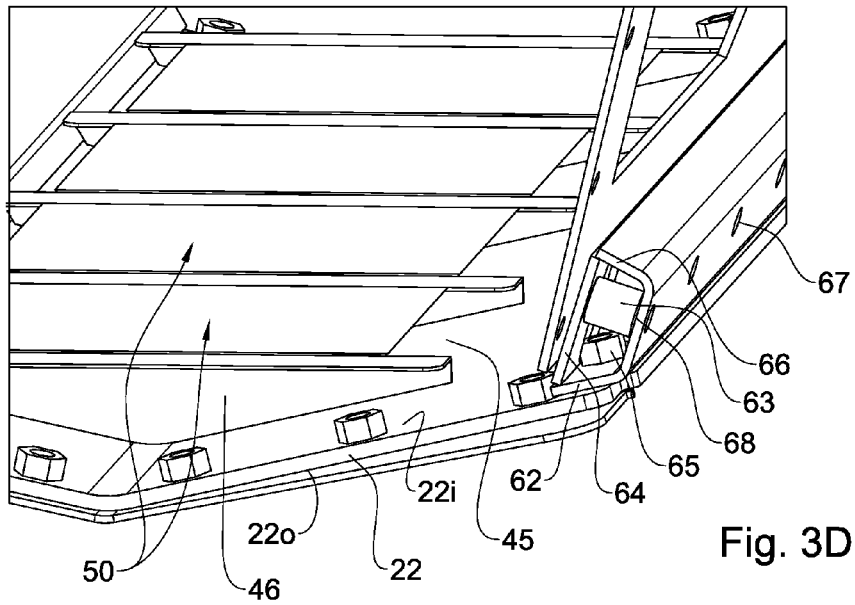
FIG. 3D is a schematic isometric view of a detail D shown in FIG. 3A.
Figure 3E:
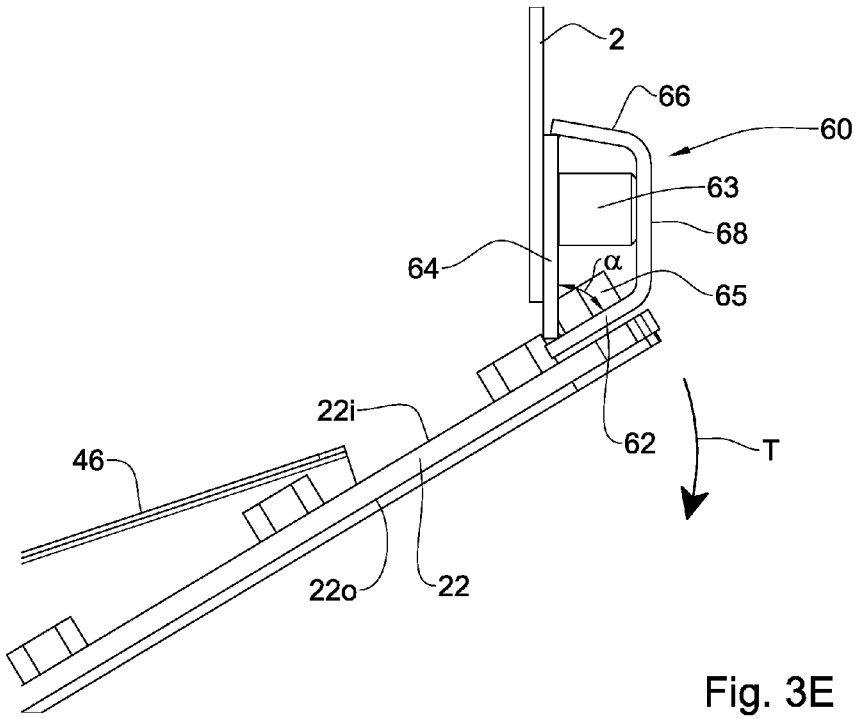
FIG. 3E is a schematic enlarged view of detail D shown in FIG. 3A.

Reverting to FIG. 2A, the cover plate is formed with a central portion 31C and two peripheral portions 31P disposed on both sides thereof, similar to the base plate 22, but at a different angle. When attached over the energy absorbing arrangement 40, the central portion 31C is attached to the longitudinal beams 42, 44 via ports 34 formed in the central portion 31C of the cover plate 30, and the peripheral portions 31P are attached to the transverse beams 46 via ports 32 formed in the peripheral portion 31P of the cover plate 30.

When the cover plate 30 is attached over the grid beams 42, 44, 46, 48—the modules received within the cells 43, 45 and are confined there by the base plate 22, cover plate 30 and grid beams 42, 44, 46, 48.

Each energy absorbing module 50 is configured for performing progressive deformation under application of a load thereto. In particular, the energy absorbing module 50 can either be a structure adapted to collapse under the load (e.g. honeycomb), or can be made of a material adapted to collapse under the load (e.g. aluminum foam).

Each such module 50 is confined within a wrapping 52 adapted to provide the energy absorbing module with structural stability, so that it only collapses/deforms under the application of a load caused by an explosion, rather than by shocks and vibrations occurring during regular operation of the vehicle. It is also noted that certain materials such as aluminum foam tend to disintegrate under vibrations, and so the wrapping provides protection against this undesired phenomena. The wrapping 52 can be made of a resilient material, e.g. Polyurea (PU) or polyethylene.

Turning to FIGS. 3A to 3E, in assembly, the side walls of the vehicle hull 1 are fitted with an attachment beam 60, having, in cross-section, a polygonal shape with four sides 62, 64, 66 and 68. The design is such that the side 68 is parallel to the side 64, while the side 62 is angled to the side 64 at an angle corresponding to that of the peripheral portions 22P of the base plate 22.

Thus, in assembly, the side 64 is configured for attachment to the side walls of the vehicle hull 1 via steel spacers 63 (passing also through side 68), and the side 62 is configured for attachment to the peripheral portions 22P of the base plate assembly 22 using bolts 65. The peripheral portions 22P, in turn, are formed with attachment ports at the ends thereof remote from the central portion 22C, configured for attachment to side 62 of the attachment beam 60.

It is noted that under the above design, the only direct contact between the belly armor 10 and the vehicle hull 1 is through the attachment beam 60, so that the belly armor 10 'hangs' from the attachment beam 60. Under this design, there is no direct contact (when the vehicle is at rest), between the belly armor 10 and the belly of the vehicle 1 and/or the chassis CH.

In an assembled position, when the vehicle is positioned on the ground on its wheels, the belly armor 10 extends between the belly of the vehicle and the ground, such that the base plate assembly 20 faces the ground, while the cover plate faces the vehicle.

In operation, at the event of an explosion under the belly armor 10, the force of the explosion will first impact the deflector plate 24 and be dispersed to the sides (towards the peripheral portions 22P) owing to the V-shape design of the belly armor 10.

The loads still applied to the base plate 22 by the explosion will be dispersed over the base plate 22 being partially absorbed thereby, causing the base plate 22 to deform in an upward direction (i.e. towards the belly of the vehicle 1). However, due to the grid beams, the base plate is prevented from deforming to an extent which may affect the passengers occupying the vehicle.

On the other hand, the base plate 22 is configured for undergoing deformation to an extent sufficient to allow it to transfer the energy of the explosion to the energy absorbing modules 50. In other words, the base plate 22 will deform so as to depress the energy absorbing modules 50 arranged between the base plate assembly 20 and the cover plate 30. Owing to the longitudinal beams 42, 44 and transverse beams 46, 48, the majority of the energy of the explosion is designed to be absorbed by the collapse/deformation of the modules 50 rather than by structural deformation of the base plate assembly 20.

In addition, during an explosion, the loads applied to the base plate 20 of the belly armor 10 tend to apply to the base plate assembly 20, a torque T (shown FIG. 3E) which operates to detach the base plate assembly 20 from the hull 1. However, since the belly armor 10 is attached to the attachment beam 60 and not directly to the hull 1, the torque operates against the angled side 62 of the attachment beam 60, and not directly on the side walls of the hull 1.

It should thus be understood that by adding the attachment beam 60, the entire area of attachment between the hull 1 and the belly armor 10 is more robust and reinforced, and also prevents direct operation of the belly armor 10 on the hull 1 during explosion.

Those skilled in the art to which this invention pertains will readily appreciate that numerous changes, variations, and modification can be made without departing from the scope of the invention, mutatis mutandis.

The invention claimed is:

1. A blast armor for a belly forming part of a hull of a vehicle, comprising:

a base plate made of a ballistic material and having an inner surface and an outer surface;

a cover plate separate from the hull of the vehicle to which the blast armor is to be mounted, the cover plate made of ballistic material and spaced from the inner surface of the base plate to form a space therebetween; and at least one energy absorbing module disposed within the space between the base plate and the cover plate, the at least one energy absorbing module having:

a front surface;

a rear surface; and side surfaces extending therebetween;

the at least one energy absorbing module being positioned so that at least one of its surfaces faces the base plate and at least one other surface thereof faces the cover plate;

wherein:

the base plate and the cover plate are each made of a material having a toughness greater than that of the at least one energy absorbing module; and the at least one energy absorbing module is configured to progressively deform between the base plate and the cover plate, under the application of a force to the outer surface of the base plate at least partially directed towards its inner surface.

2. The blast armor according to claim 1, wherein the at least one energy absorbing module occupies an area constituting a minority of an area of the base plate or the cover plate.

3. The blast armor according to claim 1, wherein the at least one energy absorbing module is provided with a frame in the form of a cell having at least two opposing side walls confining at least two sides of the at least one energy absorbing module, the frame being attached to the inner surface of the base plate.

4. The blast armor according to claim 3, wherein the at least one energy absorbing module is confined:

at its front face by the base plate;

along its side faces by the side walls of the cell; and at its rear face by the cover plate.

5. The blast armor according to claim 1, wherein the at least one energy absorbing module includes a plurality of modules that are provided to cover a majority of the inner surface of the base plate.

6. The blast armor according to claim 1, wherein the base plate is made of a single continuous piece of ballistic material.

7. The blast armor according to claim 1, wherein the blast armor is designed to withstand the impact of a level 3 explosion on the STANAG 4569 scale.

8. The blast armor according to claim 7, wherein the same blast armor without the at least one energy absorbing energy absorbing module is configured for withstanding a level 2 on the STANAG 4569 scale.

9. The blast armor according to claim 1, wherein both the base plate and the cover plate have a nominal hardness ranging between 220 and 650 BHN.

10. The blast armor according to claim 1, wherein the thickness of the cover plate is between 25% and 50% of the thickness of the base plate.

11. The blast armor according to claim 1, further comprising a plurality of grid beams at the inner surface of the base plate, such that a grid of cells is formed along the inner surface, configured for holding therein a plurality of energy absorbing modules which includes the at least one energy absorbing module.

12. The blast armor according to claim 11, wherein the number of plurality of energy absorbing modules is similar to the number of cells formed by the grid beams, such that each cell is occupied by one energy absorbing module, adjacent modules being separated from each other by the cells' walls.

13. The blast armor according to claim 1, wherein the blast armor is an add-on armor, adapted to be attached in a removable manner to the body to be protected.

14. The blast armor according to claim 13, wherein the blast armor is sized and shaped for mounting, externally, onto a vehicle so as to cover a belly thereof.

15. An armored vehicle comprising:

a hull having:

a front end and a rear end defining therebetween a first direction of the vehicle:

a belly extending along the first direction; and side walls extending along the first direction transverse to the belly;

a belly armor according to claim 1 mounted onto the vehicle hull such that when mounted, the cover plate, grid beams and the at least one energy absorbing module are disposed between the base plate and the belly of the vehicle.

16. The armored vehicle according to claim 15, wherein the blast armor is sized and shaped for mounting, externally, onto a vehicle so as to cover a belly thereof.

17. The armored vehicle according to claim 16, wherein the vehicle comprises a hull having the belly and side walls extending therefrom, and the blast armor is configured for attachment to the side walls.

18. The armored vehicle according to claim 17, wherein the base plate is provided with at least two extensions being formed with the attachment ports for mounting the blast armor onto the vehicle.

19. The armored vehicle according to claim 18, wherein the arrangement is such that the side walls or belly of the vehicle are fitted with one or more intermediary members fixedly attached thereto, the intermediary member being configured for attachment thereto of the at least two extensions of the base plate.

20. The armored vehicle according to claim 18, wherein each intermediary member extends in a direction parallel to the belly of the hull and along the side walls thereof, and has, in a cross-section taken along a plane perpendicular to this direction, at least one side configured for attachment to the hull and another side configured for attachment thereto of the base plate of the armor.

21. The armored vehicle according to claim 20, wherein the intermediary member, in cross section taken along the same plane, is formed with a first side oriented parallel to the side wall of the hull, and a second side wall angled to the first side wall, and configured to be oriented parallel to the peripheral portion of the base plate.

22. The armored vehicle according to claim 21, wherein there is no direct contact between the blast armor and the belly of the vehicle and/or a chassis thereof, when the blast armor is mounted onto the vehicle.

23. The blast armor according to claim 1, wherein the armor is formed with attachment ports configured for attachment thereof to the body to be protected.

24. The blast armor according to claim 23, wherein the base plate of the armor is fitted or integrally provided with at least two extensions being formed with the attachment ports.

25. The blast armor according to claim 24, wherein, when mounted, the attachment ports of the extensions are configured to engage corresponding ports formed in the a hull of the vehicle.

26. The blast armor according to claim 24, wherein the at least two extensions constitute part of peripheral portions of the base plate.

* * * * *